US005957107A

United States Patent [19]

Kadota

[11] Patent Number: 5,957,107

[45] Date of Patent: Sep. 28, 1999

[54] FUEL INJECTION CONTROL METHOD FOR CYLINDER INJECTION TYPE INTERNAL COMBUSTION ENGINE AND SYSTEM FOR CARRYING OUT THE SAME

[75] Inventor: Yoichi Kadota, Tokyo, Japan

[73] Assignee: Mitsubishi Denki Kabushiki Kaisha, Tokyo, Japan

[21] Appl. No.: 08/982,461

[22] Filed: Dec. 2, 1997

[30] Foreign Application Priority Data

Jan. 16, 1997 [JP] Japan ..... 9-005558

[51] Int. Cl.[6] ..... F02B 5/00

[52] U.S. Cl. ..... 123/305; 123/295; 123/179.16

[58] Field of Search ..... 123/478, 295, 123/305, 197.16, 179.17, 198 OB

[56] References Cited

U.S. PATENT DOCUMENTS

| | | | |
|---|---|---|---|
| Re. 35,195 | 4/1996 | Nagono et al. | 123/478 |
| 5,086,737 | 2/1992 | Watanabe et al. | 123/305 |
| 5,090,386 | 2/1992 | Kurosu et al. | 123/478 |
| 5,113,833 | 5/1992 | Nagono et al. | 123/491 |
| 5,136,996 | 8/1992 | Kushi et al. | 123/332 |
| 5,615,645 | 4/1997 | Kanno | 123/478 |
| 5,749,334 | 5/1998 | Oda et al. | 123/305 |

FOREIGN PATENT DOCUMENTS 4-187819 7/1992 Japan .

*Primary Examiner*—John Kwon

*Attorney, Agent, or Firm*—Sughrue, Mion, Zinn, Macpeak & Seas PLLC

[57] ABSTRACT

A fuel injection control system for a cylinder injection type internal combustion engine. The system includes an engine control unit (8) for controlling fuel injectors (11) so that fuel injection is forcibly carried out in a suction stroke of the engine immediately before the engine (1) is stopped, wherein the quantity of intake air fed to the internal combustion engine (1) in the suction stroke is forcibly increased. Only the ignition process is validated after the interruption of the fuel supply. By stopping the engine immediately after the suction stroke in which the fuel injection is performed, desirable starting performance of the engine is ensured in the succeeding operation thereof. Enhanced staring performance of the engine can be realized even in the existing engine without incurring high cost and increase in the processing overhead.

6 Claims, 4 Drawing Sheets

FUEL INJECTION CONTROL METHOD FOR CYLINDER INJECTION TYPE INTERNAL COMBUSTION ENGINE AND SYSTEM FOR CARRYING OUT THE SAME

BACKGROUND OF THE INVENTION

1. Field of the Invention

The present invention relates generally to a fuel injection control method for a cylinder injection type internal combustion engine for a motor vehicle in which fuel is injected directly into engine cylinders, and a system for carrying out the method.

2. Description of Related Art

As the fuel injection control system for the cylinder injection type engine which is designed for injecting the fuel directly into the cylinders of a gasoline engine, there may be mentioned a control system disclosed, for example, in Japanese Unexamined Patent Application Publication No. 237854/1992 (JP-A-4-237854). The cylinder injection type internal combustion engine attracts attention as an ideal engine promising advantageous and profitable effects which may be globally classified into four types, as mentioned below.

1. Reduction of Harmful Gases Contained in Engine Exhaust Gas

In the conventional fuel injection system in which the fuel is injected by the injector mounted externally of the engine cylinders, a part of the fuel injected from the injector will adhere to inner walls of the intake pipe, surfaces of the intake valves of the engine and others. Such fuel deposition has to be taken into consideration particularly when the engine is operating at a low temperature such as engine starting operation, which is unfavorable for vaporization of the fuel or when the engine is in a transient operation state where the amount or quantity of fuel to be supplied to the engine has to be changed at a relatively high speed. By contrast, in the cylinder injection type internal combustion engine, the air-fuel mixture can be made lean without taking into consideration the delay involved in the transportation of the fuel, whereby the amounts of harmful HC (hydro carbon) and CO (carbon monoxide) contained in the exhaust gas can be reduced significantly.

2. Reduction of Fuel Cost

Because the fuel is injected immediately before the ignition timing upon injection of the fuel into the engine cylinders, there is formed a mass of combustible fuel mixture around the spark plug at the time point for ignition, making nonuniform the distribution of the gas mixture containing the fuel within the cylinder. Thus, the fuel-air mixture undergoes a so-called stratified combustion. Consequently, the air-fuel ratio in appearance between the amount of air and that of the fuel charged into the cylinder can be significantly decreased so that the air-fuel mixture is rendered lean correspondingly. Besides, owing to the stratified combustion, combustion of the air-fuel mixture is scarcely subjected to adverse influence of the exhaust gas recirculation with increased ratio. By virtue of these features in addition to lowering of the pumping loss, fuel-cost performance of the engine system can be enhanced.

3. Increased Output Power

Since the combustion of the air-fuel mixture occurs concentratedly around the spark plug owing to the stratified combustion, the amount of end gas (i.e., air-fuel mixture gas existing in regions remote from the spark plug) decreases, whereby the anti-knocking performance of the engine can be enhanced with the compression ratio being increased.

Furthermore, because the fuel is converted into gas (i.e., gasified) within the cylinder, the intake air is deprived of heat as vaporization heat. Consequently, the density of the intake air increases, which is effective for increasing the volumetric efficiency and hence the output power of the engine.

4. Improvement of Drivability

By virtue of the direct fuel injection into the cylinder, the time taken for generating the output torque by the engine from the fuel injection through intervention of the fuel combustion is shorter when compared with the conventional engine in which the fuel is injected externally of the engine cylinder. Thus, the engine system capable of responding to the demands of a driver with high speed can be realized.

Although the cylinder injection type internal combustion engine has advantageous features such as mentioned above, it suffers some problems. Namely, because the fuel (gasoline) is directly charged into the cylinder, the air-fuel mixture tends to converge around the spark plug when compared with the conventional engine in which the fuel is charged by the injector mounted externally of the engine cylinder, as a result of which the spark plug is susceptible to deposition of soot. In particular, in the cylinder injection type engine in which the fuel injection is performed in the explosion stroke, the soot deposition phenomenon is more likely to take place because of intensive concentration of the fuel around the spark plug. In this conjunction, it is noted that when the engine operation is stopped in the state where soot is deposited on the spark plug, the starting performance of the engine in the succeeding engine starting operation will be accompanied with degradation because of the soot deposition on the spark plug. In particular, when the fuel pump designed to operate in synchronism with the engine rotation is employed, the fuel injection pressure is likely to vary because the engine rotation speed is intrinsically low in the engine stating operation, incurring thus instability of the fuel supply to the cylinder. Furthermore, when the engine temperature is low, an increased quantity of fuel has to be injected, which results in that the unwanted phenomena mentioned above make a more marked appearance, to further disadvantage.

In the cylinder injection type engine known heretofore, when the ignition switch is turned off by the driver, the power supply to the ignition system is interrupted by an external circuit, making it impossible to perform ignition control. Consequently, the engine operation will be stopped in the state where the fuel as injected remains unburned when the ignition switch is opened, which is unfavorable for the succeeding starting operation of the engine.

SUMMARY OF THE INVENTION

In the light of the state of the art described above, it is an object of the present invention to provide a fuel injection control method for a cylinder injection type internal combustion engine which method is capable of stopping engine operation in the state where the spark plug is clean, to thereby ensure enhanced starting performance of the engine by stabilizing the combustion of air-fuel mixture.

It is another object of the present invention to provide a fuel injection control system for carrying out the above-mentioned method.

In view of the above and other objects which will become apparent as the description proceeds, there is provided according to a general aspect of the present invention a fuel injection control system for a cylinder injection type internal combustion engine, which system includes an air flow sensor means for detecting at least either one of an intake air flow fed to the internal combustion engine and a parameter corresponding to the intake air flow, a crank angle sensor means for detecting rotation speed (rpm) of the internal combustion engine and a crank angle thereof, a fuel injector means for injecting fuel directly into individual cylinders of the internal combustion engine, and an engine control unit for controlling the fuel injector means, wherein the engine control unit includes an arithmetic means for determining on the basis of information supplied from the air flow sensor means and the crank angle sensor means a quantity of fuel to be injected directly in each of the cylinders of the internal combustion engine and means for controlling the fuel injector means so that the quantity of fuel determined by the arithmetic means is injected directly into the individual cylinders of the internal combustion engine. The engine control unit further includes a means for controlling the fuel injector means so that fuel injection is carried out in a suction stroke of the engine immediately before operation of the internal combustion engine is stopped.

In a preferred mode for carrying out the invention, the engine control unit may be so designed as to increase the quantity of intake air fed to the internal combustion engine upon fuel injection in the suction stroke immediately preceding the stoppage of the engine operation when compared with an ordinary fuel injection control.

In another preferred mode for carrying out the invention, the engine control unit may be so designed as to carry out an ignition process at least once for each of the engine cylinders in succession to interrupt of the fuel supply to the engine after the fuel injection to the internal combustion engine in the suction stroke has been carried out.

According to another aspect of the present invention, there is provided a method of a fuel injection control method for a cylinder injection type internal combustion engine, which method includes the steps of detecting at least either one of an intake air flow fed to the internal combustion engine and a parameter corresponding to the intake air flow, detecting rotation speed of the internal combustion engine and a crank angle thereof, injecting fuel directly into individual cylinders of the internal combustion engine, determining arithmetically a quantity of the fuel to be injected directly in each of the cylinders on the basis of the intake air flow or the corresponding parameter, the rotation speed and the crank angle of the engine, controlling the fuel to be injected directly into the individual cylinders of the internal combustion engine in a quantity corresponding to the arithmetically determined fuel quantity, and injecting fuel in a suction stroke of the engine immediately before the internal combustion engine is stopped.

In a preferred mode for carrying out the method mentioned above, the quantity of intake air fed to the internal combustion engine upon fuel injection in the suction stroke immediately before the internal combustion engine is stopped may be increased when compared with a fuel quantity in an ordinary fuel injection type internal combustion engine.

In another preferred mode for carrying out the method described above, there may further be provided a step of performing an ignition process at least once for each of the engine cylinders in succession to interrupt of the fuel supply to the engine after the fuel supply to the internal combustion engine in the suction stroke.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIGS. 3A and 3B are flow charts for illustrating procedures executed by a conventional fuel control system known heretofore in comparison with the system according to the invention, wherein FIG. 3A shows a conventional fuel injection control procedure, and FIG. 3B shows a conventional ignition control procedure; and FIGS. 4A and 4B are flow charts for illustrating control procedures adopted in the fuel injection control system for the cylinder injection type engine acceding to an embodiment of the present invention, wherein FIG. 4A shows a fuel injection control procedure, and FIG. 4B shows an ignition control procedure.

DESCRIPTION OF THE PREFERRED EMBODIMENTS

Figure 1:
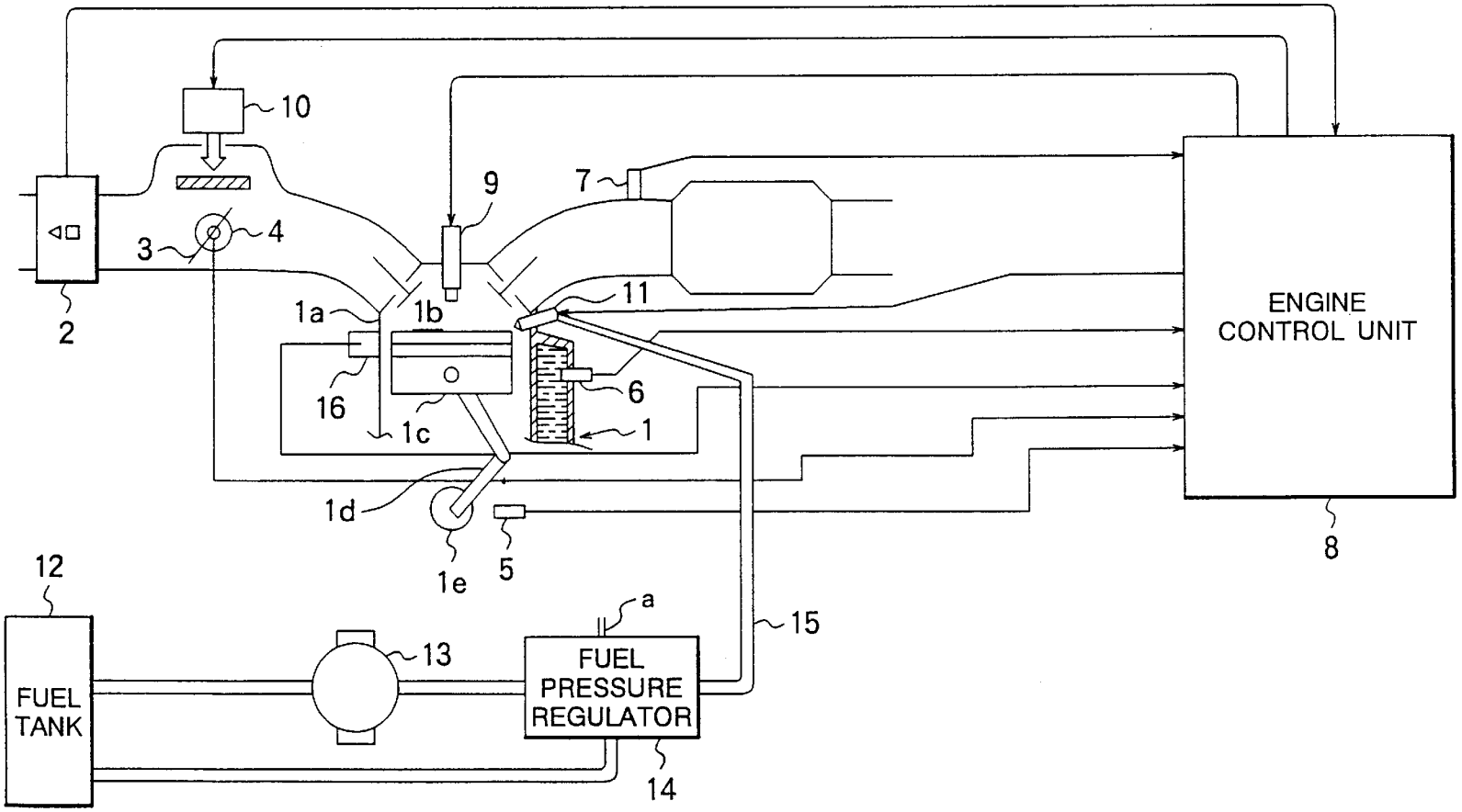
FIG. 1 is a schematic diagram showing generally a cylinder injection type internal combustion engine equipped with a fuel injection system according to an embodiment of the present invention.

Now, the present invention will be described in detail in conjunction with what is presently considered as preferred or typical embodiments thereof by reference to the drawings. In the following description, like reference characters designate like or corresponding parts throughout the several views.

Figure 2:
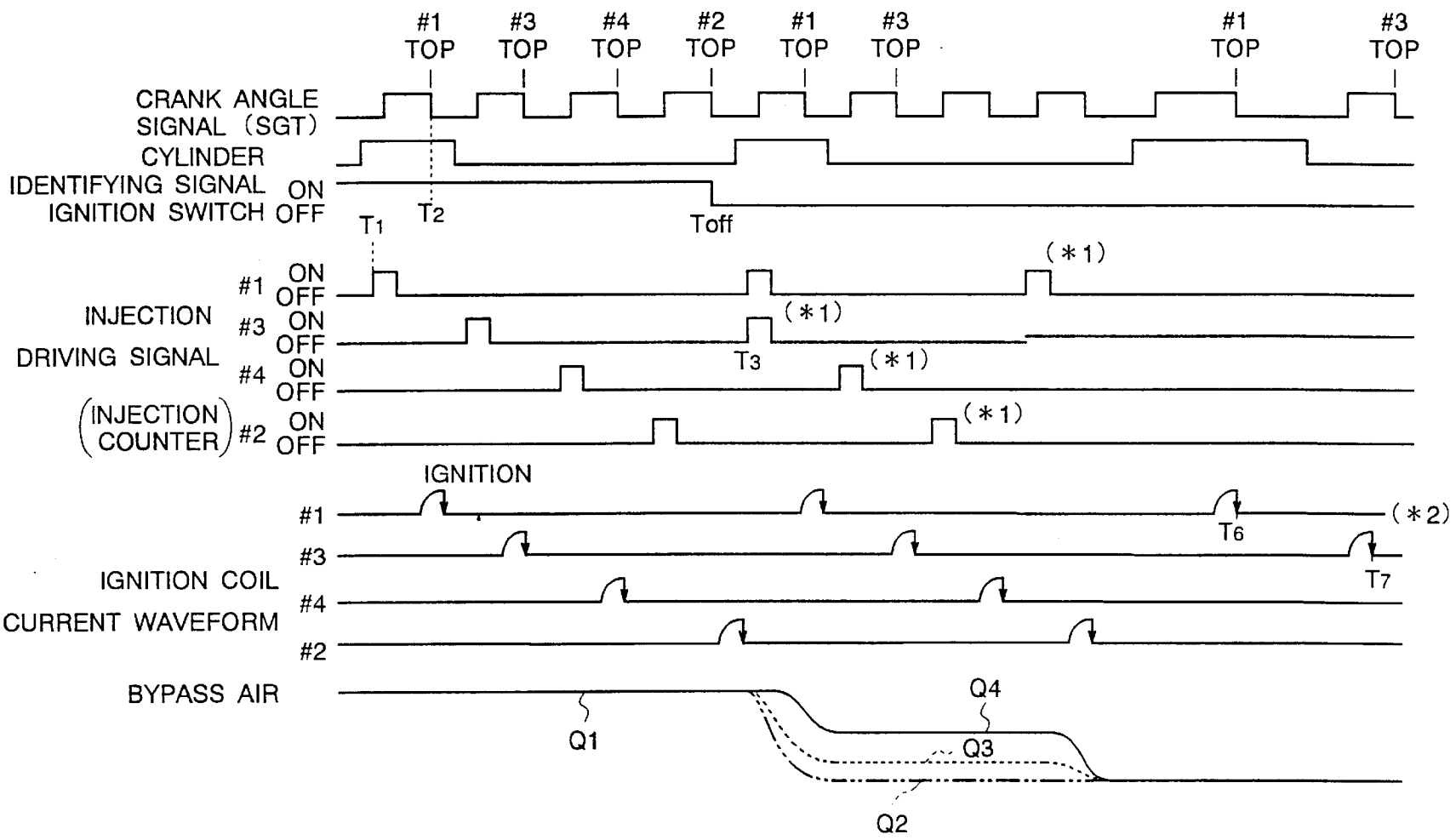
FIG. 2 is a timing chart for illustrating the fuel injection control operation performed by an engine control unit shown in FIG. 1.
Figure 3A:
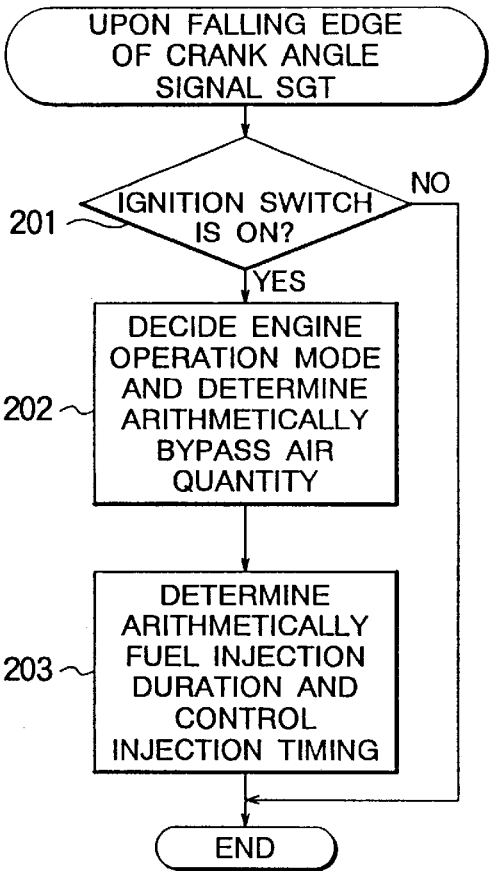
PRIOR ART FIG. 3A
Figure 3B:
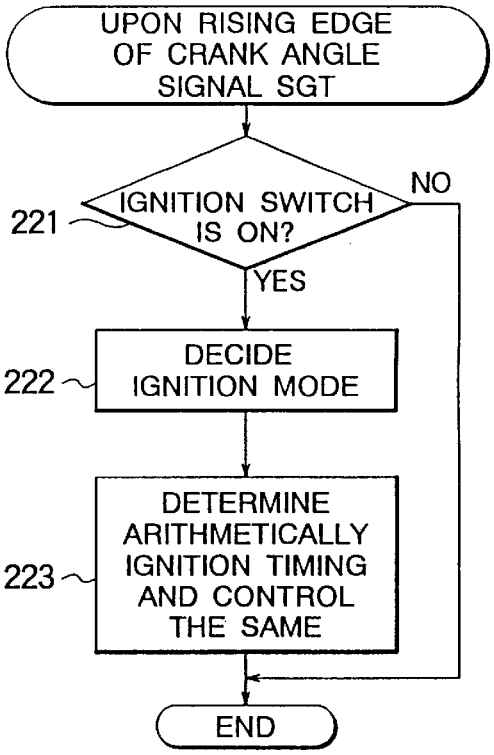
PRIOR ART FIG. 3B
Figure 4A:
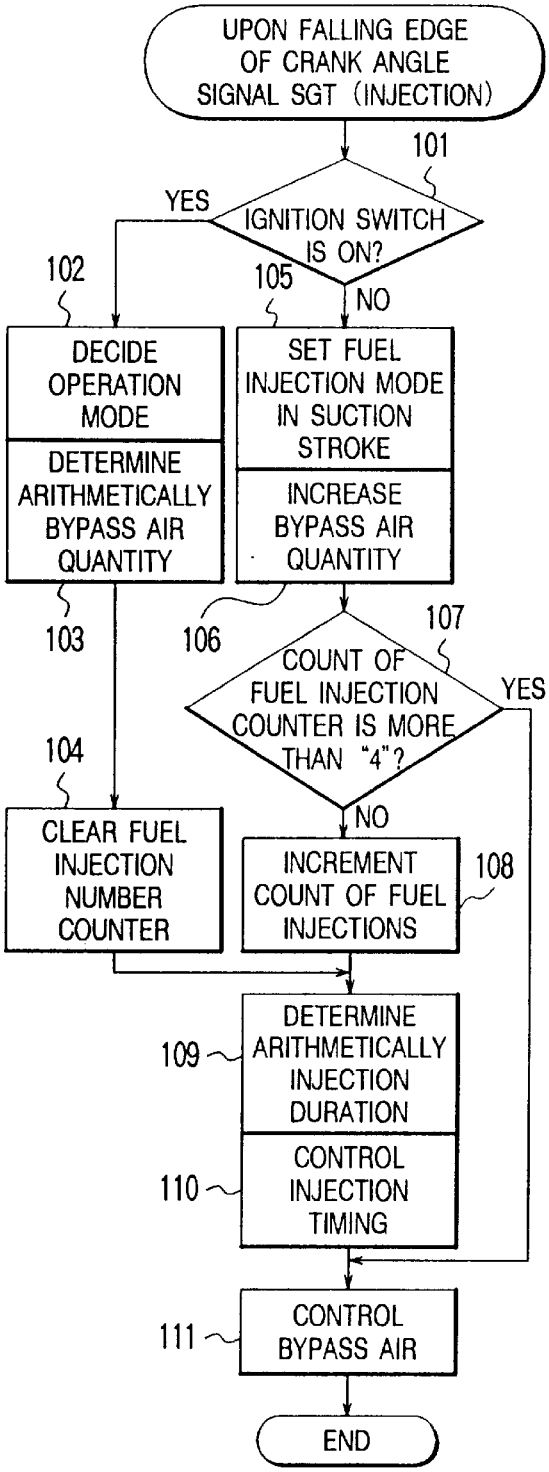
Figure 4B:
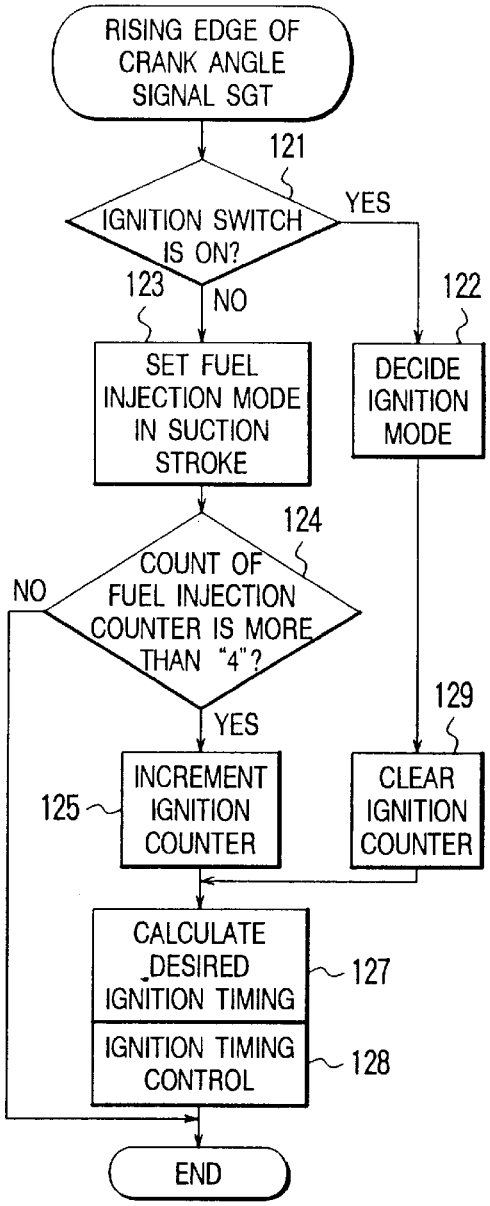

FIG. 1 is a schematic diagram showing generally a cylinder injection type internal combustion engine equipped with a fuel injection system according to an embodiment of the present invention, FIG. 2 is a timing chart for illustrating the fuel injection control operation performed by an engine control unit shown in FIG. 1, FIGS. 3A and 3B illustrate procedures executed by a conventional fuel control system known heretofore for comparison with the system according to the invention, and FIGS. 4A and 4B illustrate a fuel injection control procedure and an ignition control procedure adopted in the fuel injection control system for the cylinder injection type engine acceding to an embodiment of the invention.

Referring to FIG. 1, a cylinder injection type internal combustion engine for a motor vehicle includes an air flow sensor 2 for measuring an intake air flow rate of the air sucked into the engine, a throttle valve 3 which is operatively coupled to an accelerator pedal (not shown) manipulated by a driver of the motor vehicle for regulating the air flow supplied to the engine 1, a throttle position sensor 4 for detecting the angular position of the throttle valve 3, a crank angle sensor 5 for detecting a rotation speed (rpm) of the engine and an angular position of a crank shaft, a water temperature sensor 6 for detecting the temperature of cooling water of the engine and serving as a means for detecting the warmed-up state of the engine, an $O_2$-sensor 7 provided in association with an exhaust pipe of the engine for detecting the oxygen concentration of the exhaust gas, a control unit 8 for deciding engine operating states on the basis of information supplied from the various sensors installed in association with the concerned portions of the engine to determine arithmetically various control quantities in dependence on the detected engine operating states for thereby allowing the air-fuel mixture charged into the engine cylinders to undergo combustion at a desired air-fuel ratio, spark plugs 9 of a conventional type, and an air bypass valve 10 for controlling the air flow bypassing the throttle valve 3. The air bypass valve 10 is employed for the engine rotation speed (rpm) control in the idling operation state in which the throttle valve 3 is fully closed as well as for the engine torque control in the running state of the motor vehicle.

The internal combustion engine 1 has at least one cylinder 1*a*. In the following description, however, it is assumed, only by way of example, that the engine includes four cylinders only one of which is shown in FIG. 1. In each of cylinder heads of the cylinders 1*a*, a fuel injector 11 is mounted for supplying the fuel directly into the cylinder 1*a* in such orientation or disposition that a tip end portion of the fuel injector 11 is exposed in a combustion chamber 1*b* defined within the cylinder 1*a*. A piston 1*c* is disposed within each of the cylinders 1*a* to be movable reciprocatively, wherein each piston is operatively combined with the cylinder 1*a* by way of a piston rod 1*d*. The spark plug 9, the air bypass valve 10 and the fuel injector 11 are controlled by the engine control unit 8.

The cylinder injection type internal combustion engine system according to the instant embodiment of the invention is further provided with a fuel tank 12, a fuel pump 13 for feeding the fuel to the fuel injectors from the fuel tank 12 and a fuel pressure regulator 14 for regulating the pressure of the fuel fed to the fuel injectors 11 (at b in FIG. 1). More specifically, the fuel pressure regulator 14 controls the fuel pressure prevailing within a fuel passage 15 extending to the fuel injector 11 from the fuel pressure regulator so as to be constant at several ten atm. by reference to the detected atmospheric pressure inputted at a in FIG. 1.

Further provided is a cylinder identifying sensor 16 mounted on a cam shaft (not shown) driven rotationally, being interlocked with the crank shaft 1*e*. The sensor 16 outputs the cylinder identifying signal.

FIG. 2 is a timing chart for illustrating the engine control operation of the engine control unit 8 shown in FIG. 1, wherein time is taken along the abscissa while shown along the ordinate from the top to the bottom are the crank angle signal SGT, cylinder identifying signal, ignition switch signal IGS, driving signals for the fuel injectors 11 of the individual cylinders #1, #3, #4 and #2, ignition coil current waveforms for the individual cylinders #1, #3, #4 and #2 and air flow rate in the bypass passage, respectively.

The crank angle signal SGT is outputted from the crank angle sensor 5 shown in FIG. 1 and represents the angular position of the crank shaft 1*e*, i.e., the position of the piston 1*c*, wherein a falling edge of the crank angle signal SGT indicates that the piston lc of the cylinder la is at the top dead center. In the case of the illustrated four-cylinder engine, the period of the crank angle signal is 180° CA (i.e., in terms of the crank angle), corresponding to the ignition timing interval of the individual cylinder 1*a*.

The cylinder identifying signal is outputted from the cylinder identifying sensor 16 shown in FIG. 1, as mentioned previously. When the output signal of the high level (H) signal is detected at the falling edge of the signal outputted from the crank angle sensor 5 at the timing corresponding to the top dead center of the piston (i.e., at the time point $T_2$), this means that the piston of the first cylinder #1 is at the top dead center in the compression stroke.

The ignition switch signal IGS represents the state of the key switch signal which assumes an ON or high level (H-level) when the driver puts into operation the engine while assuming an OFF or low level (L-level) when the engine is stopped.

The injector driving signals are supplied from the engine control unit 8 to the spark plugs 9 provided for the individual cylinders 1*a* (#1, . . . , #4), respectively. When the injector driving signal is at high level H, the corresponding fuel injection is actuated.

Furthermore, waveforms of currents are supplied to the spark plugs 9 (#1, . . . , #4) mounted in the cylinders 1*a*, respectively, in accordance with the ignition control signal outputted from the engine control unit 8, wherein the ignition takes place at the timing corresponding to the falling edge of the ignition coil current pulse.

The bypass air quantity represents the air flow in the bypass passage shunting the throttle valve 3 of the engine, wherein the airflow is regulated by the air bypass valve 10 which in turn is controlled by the engine control unit 8.

Next, description will turn to the operation of the fuel injection control system according to the instant embodiment of the invention by reference to FIG. 2.

Referring to FIG. 2, it is assumed that the compression stroke fuel injection control (i.e., fuel injection control in a compression stroke of the engine) is performed at a time point immediately before the ignition switch is turned off at a time point Toff shown in FIG. 2. More specifically, describing in conjunction with the first cylinder #1, ignition therefor is effectuated in the vicinity of a time point $T_2$ at which the piston 1*c* reaches the top dead center in the compression stroke, while the fuel injector for the first cylinder #1 is driven at a time point $T_1$ preceding to the time point $T_2$ about 60° in terms of the crank angle (hereinafter referred to as "CA" in abbreviation), which is then followed sequentially by the similar controls of the third cylinder #3, the fourth cylinder #4 and then the second cylinder #2, respectively, at a time interval corresponding to the period of the crank angle signal, i.e., at every 180° CA.

Now, description will be made of operation of the fuel injection control system after the ignition switch is turned off at the time point Toff. In the conventional engine system, neither the fuel injection nor the ignition is performed after the ignition switch is turned off (Toff). However, in the cylinder injection type internal combustion engine which the present invention is concerned with, the fuel injection control is performed for some time even after the time point Toff at which the ignition switch is turned off. More specifically, the fuel injector 11 is driven for the third cylinder #3 for which the fuel injection is performed immediately after the time point $T_3$ preceding by 300° CA to the time point $T_4$ at which the piston of the third cylinder #3 reaches the top dead center in the compression stroke, i.e., preceding to the time point $T_4$ about two and a half period of the crank angle signal. In other words, the fuel injector 11 provided in association with the third cylinder #3 is driven in the suction stroke. Parenthetically, the suction stroke fuel injection is designated by reference symbol "*1" in FIG. 2.

In the course of the fuel injections effected sequentially in the suction strokes of the individual cylinders in the order of the third cylinder #3, the fourth cylinder #4, the second cylinder #2 and then the first cylinder #1, the air bypass valve 10 is so controlled that an amount of bypass air is introduced into the engine through the bypass passage by controlling correspondingly the air bypass valve 10. More specifically, when the fuel injection is performed in the compression stroke for realizing an ultra-lean air-fuel mixture combustion, a large amount of bypass air is introduced, as indicated by a curve $Q_1$ in FIG. 2. When the ignition switch is turned off at the time point Toff, electric energization of the air bypass valve 10 is simultaneously broken, as a result of which the quantity of a bypass air decreases rapidly, as indicated by a curve $Q_2$ in FIG. 2.

However, in order to realize the fuel injection in the suction stroke after the turn-off of the ignition switch at the time point Toff, a bypass air quantity required for the suction stroke fuel injection is fed to the engine, as indicated by a broken curve $Q_3$ in FIG. 2.

According to the teaching of the invention, a relatively large amount of the bypass air is forcively introduced, as can be seen from a curve $Q_4$ shown in FIG. 2.

After the fuel injections in the suction stroke of the third cylinder #3, the fourth cylinder #4, the second cylinder #2 and then the cylinder #1, respectively, in this sequence in succession to the turn-off of the ignition switch at the time point Toff, the driving operation for the fuel injectors is stopped, and thereafter only the ignition control is carried out. More specifically, the fuel finally injected into the first cylinder #1 at a time point $T_5$ undergoes combustion at the ignition timing $T_6$ of the first cylinder #1. Thereafter, the fuel is no more delivered to the engine and only the ignition signal is outputted at a time point $T_7$, as indicated by (*2) in FIG. 2. With this control scheme, it is inherently desirable to perform only the ignition process for all the engine cylinders. However, because the fuel is not supplied with the engine operating under the inertia, it can not always be ensured that the injection control is performed for all of the four cylinders.

Next, referring to FIGS. 3 and 4, the control procedure according to the invention will be described by comparing with the control process adopted in the conventional fuel injection control system. In FIGS. 3 and 4 illustrating the controls in the hitherto known system and the inventive system, respectively, there are shown at the left-hand side the fuel injection control and the bypass air control executed by a CPU incorporated in the engine control unit 8 in synchronism with the falling edge of the crank angle signal SGT (see FIG. 2), while shown at the right-hand side are the ignition timing control procedures executed in synchronism with the rising edge of the crank angle signal SGT.

At first, referring to FIGS. 3A and 3B, description will be directed to the injection control and the ignition timing control in the conventional system where the fuel injection is performed externally of the engine cylinders.

In the case of the conventional system, when the ignition switch is turned on at the falling edge of the crank angle signal SGT (step 201), a decision is made as to the engine operation state (or mode) on the basis of the information available from the various sensors installed on the engine as mentioned previously, wherein the bypass air control quantity corresponding to the engine operation state as detected is arithmetically determined (step 202), which is then followed by a step 203 where the injector driving duration (pulse width of the injector driving signal) and the drive timing are arithmetically determined on the basis of the control quantities, whereby a control signal corresponding to the control quantity is outputted (step 203), as can be seen from FIG. 3A.

When the ignition switch is turned off in the step 201, the bypass air control is not performed but the processing activated at the falling edge of the crank angle signal SGT is terminated.

In the case of the conventional system, when the ignition switch is turned on at the rising edge of the crank angle signal SGT (step 221), a decision is made as to the ignition mode (step 222), whereon the ignition timing is arithmetically determined on the basis of the ignition mode to thereby output the ignition timing control signal relevant to the ignition mode (step 223), as can be seen in FIG. 3B.

Next, referring to FIGS. 4A and 4B, description will be made of the fuel injection control and the ignition timing control in the inventive system in which the fuel injection is performed directly into the engine cylinders. Parenthetically, FIGS. 4A and 4B show the embodiments covered by the invention set forth in claims 1 to 3, wherein processing steps 105 and 123 correspond to processings set forth in claim 1 with the processing steps 104, 107, 108, 124, 125 and 126 corresponding to the processing set forth in claim 3. The other steps are common to the arrangements set forth in all the claims.

At first, description will turn to the processing executed at the falling edge of the crank angle signal SGT by reference to FIG. 4A. When the ignition switch is turned on (step 101), decision is made as to the engine operation state on the basis of the information available from the various sensors installed on the engine as mentioned previously, as in the case of the conventional system (step 102). After the bypass air control quantity corresponding to the engine operation state as detected is arithmetically determined (step 103), and a fuel injection counter for counting the fuel injections is cleared at a time point at which the ignition switch is turned off (step 104). Thereafter, the injector driving duration (pulse width of the injector driving signal) is determined arithmetically (step 109) to control the drive timing for the fuel injector (step 110) and the bypass air quantity (step 111).

On the other hand, when the ignition switch is detected as being off in the step 101, the control mode is forcibly set to the suction stroke fuel injection mode (step 105) to thereby allow the bypass air quantity to be increased (step 106).

Subsequently, in a step 107, it is decided whether or not the count of the aforementioned fuel injection counter is less than "4", i.e., whether or not the number of times the fuel injection has been performed does not exceed "four". If the decision step 107 results in affirmation "YES", the fuel injection counter is incremented by one (step 108), whereon the fuel injector control is performed in steps 109 and 110.

On the other hand, when the count of the fuel injection counter is decided as exceeding "four", the fuel injection control is not carried out but the bypass air control is performed.

Next, description will be directed to the processing at the rising edge of the crank angle signal SGT by reference to FIG. 4B. When the ignition switch is turned on (step 121), decision is made as to the ignition mode, similarly to the case of the conventional system (step 122), wherein the injection counter for the ignition control is cleared at the off-time of the ignition switch (step 129), whereby the ignition timing controls such as the arithmetic determination of the desired ignition timing (step 127) and the ignition timing control (current flow control to the spark plug in a step 128) are performed on the basis of the ignition mode.

On the other hand, when the ignition switch is detected to be off in the step 121, the control mode is forcibly set to the suction stroke fuel injection mode (step 123).

Subsequently, in a step 124, it is decided whether or not the count of the aforementioned fuel injection counter is less than "4", i.e., whether or not the number of times the fuel injection has been performed does not exceed "four". If the decision step 124 results in affirmation "YES", the fuel injection counter is incremented by one (step 125), whereupon the ignition timing control is performed in steps 127 and 128.

On the other hand, when it is decided that the count of the fuel injection counter is greater than "four" in the step 124, the control processing is terminated at the rising edge of the crank angle pulse SGT.

As will now be understood from the foregoing description, according to the teachings of the invention, the relatively stable fuel injection in the suction stroke (i.e., uniform combustion of the air-fuel mixture) is carried out forcibly, and thus the engine operation is stopped in the state where the spark plug is not contaminated with soot because of the stable combustion. Thus, the starting performance of the internal combustion engine can be significantly improved.

Besides, stable engine starting performance can be ensured regardless of the state in which the engine operation is stopped.

Additionally, because the spark plug is exposed to a large amount of uniformized fuel-air mixture with the bypass air being fed to the cylinder in the suction stroke, operation of the engine can be stopped in the state where the soot deposited on the spark plug can be blown off, which of course contributes to further improvement of the engine starting performance.

Furthermore, by carrying out the fuel injection in the suction stroke at least once for each of the individual cylinders (not smaller than four fuel injections, inclusive, in the case of the four-cylinder engine), interruption of the injection of the fuel, i.e., a source of soot, and then effecting the ignition at least once for each of the engine cylinders to thereby combust completely the air-fuel mixture remaining uncombusted and thus purge the engine cylinders while the engine operation is stopped in the state where the soot is deposited on the spark plug, the succeeding engine operation starting performance can be further improved.

Many modifications and variations of the present invention are possible in the light of the above techniques. It is therefore to be understood that within the scope of the appended claims, the invention may be practiced otherwise than as specifically described.

What is claimed is:

1. A fuel injection control system for a cylinder injection type internal combustion engine, comprising:

air flow sensor means for detecting at least either one of an intake air flow fed to said internal combustion engine and a value corresponding to said intake air flow;

crank angle sensor means for detecting a rotation speed of said internal combustion engine and a crank angle thereof, fuel injector means for injecting fuel directly into individual cylinders of said internal combustion engine; and an engine control unit for controlling said fuel injector means, said engine control unit including arithmetic means for determining on the basis of information supplied from said air flow sensor means and said crank angle sensor means a quantity of fuel to be injected directly in each of said cylinders of said internal combustion engine and control means for controlling said fuel injector means so that the quantity of fuel determined by said arithmetic means is injected directly into said individual cylinders of said internal combustion engine, wherein fuel injection is carried out by said fuel injector means in a suction stroke of said engine immediately before operation of said internal combustion engine is stopped.

2. A fuel injection control system for a cylinder injection type internal combustion engine according to claim 1, wherein said engine control unit is so designed as to increase the quantity of intake air fed to said internal combustion engine upon fuel injection in the suction stroke immediately preceding to said stoppage of the engine.

3. A fuel injection control system for a cylinder injection type internal combustion engine according to claim 1, wherein said engine control unit is so designed as to carry out ignition process at least once for each of said engine cylinders in succession to interrupt a fuel supply after the fuel injection to said internal combustion engine in the suction stroke has been carried out.

4. A fuel injection control method for a cylinder injection type internal combustion engine, comprising the steps of:

detecting at least either one of an intake air flow fed to said internal combustion engine and a value corresponding to said intake air flow;

detecting rotation speed of said internal combustion engine and a crank angle thereof;

injecting fuel directly into individual cylinders of said internal combustion engine;

determining arithmetically a quantity of the fuel to be injected directly in each of said cylinders on the basis of said intake air flow or said corresponding parameter, said rotation speed and said crank angle;

controlling the fuel to be injected directly into said individual cylinders of said internal combustion engine in a quantity corresponding to said arithmetically determined fuel quantity; and injecting fuel in a suction stroke of said engine immediately before said internal combustion engine is stopped.

5. A fuel injection control method for a cylinder injection type internal combustion engine according to claim 4, wherein the quantity of intake air fed to said internal combustion engine upon fuel injection in the suction stroke immediately before said internal combustion engine is stopped is increased.

6. A fuel injection control method for a cylinder injection type internal combustion engine according to claim 4, further comprising a step of:

performing an ignition process at least once for each of said engine cylinders in succession to interrupt a fuel supplied to said engine after the fuel supply to said internal combustion engine in the suction stroke.

* * * * *